US005175899A

United States Patent [19]

Lou

[11] Patent Number: 5,175,899

[45] Date of Patent: Jan. 5, 1993

[54] MATTRESS WITH MEANS TO SUPPORT BEDCLOTHES ABOVE A USER'S FEET

[76] Inventor: Kwong L. Lou, San Gabriel, Calif.

[21] Appl. No.: 881,201

[22] Filed: May 11, 1992

Related U.S. Application Data

[63] Continuation-in-part of Ser. No. 610,152, Nov. 7, 1990, abandoned.

[51] Int. Cl.[5] ..... A47C 21/02

[52] U.S. Cl. ..... 5/505.1; 5/421; 5/648; 5/922; 5/485

[58] Field of Search ..... 5/505.1, 504.1, 506.1, 5/658, 648, 651, 421, 922, 485

[56] References Cited

U.S. PATENT DOCUMENTS

| | | | |
|---|---|---|---|
| 1,547,879 | 7/1925 | Lambert | 5/505.1 |
| 2,160,443 | 5/1939 | Schadell | 5/505.1 |
| 3,803,645 | 4/1974 | Oliverius | 5/505.1 |
| 3,878,861 | 4/1968 | Lousberg | 5/505.1 |
| 3,967,334 | 7/1976 | Ricke et al. | 5/505.1 |
| 4,214,327 | 7/1980 | Smith | 5/504 |
| 4,603,444 | 8/1986 | Suits | 5/653 |
| 4,607,402 | 8/1986 | Pollard | 5/485 |

FOREIGN PATENT DOCUMENTS

| | | | |
|---|---|---|---|
| 1544119 | 10/1968 | France | 5/648 |

*Primary Examiner*—Alexander Grosz
*Attorney, Agent, or Firm*—Wen Liu

[57] ABSTRACT

A flexible member which extends about foot high is transversely mounted at the foot end of the flat mattress for supporting bedclothes at the foot end area to reduce the pressure on the upward pointed toes when a person sleeps face-up. Detachable and/or pivotable mounting means allow the flexible member to be mounted on either side and on either end of said mattress. Further, provision may be made to allow the flexible member to be selectively positioned along the length of the mattress. The flexible member is provided with electrical heating device and thermostat control for warming up the feet area.

22 Claims, 10 Drawing Sheets

MATTRESS WITH MEANS TO SUPPORT BEDCLOTHES ABOVE A USER'S FEET

This application is a Continuation-in-Part of U.S. patent application Ser. No. 07/610,152 filed Nov. 7, 1990, now abandoned.

BACKGROUND OF THE INVENTION

1. Field of the Invention

The present invention relates to a mattress and more particularly to one having a flexible foot guard mounted thereto.

2. Description of Related Art

The conventional mattress for sleeping is flat. It is generally experienced by a lot of people, when sleeping face-up on the mattress, that the weight of comforter or blanket presses on the upward pointed toes of the feet. Particularly in cold seasons, when heavy weight comforter is used and additional covers are put on the foot area, this causes discomfort to the pointed toes of the feet as the toes have to support substantial weight of the covers. Because of the pressure on the toes, it is hard for the person to fall asleep unless he changes his sleeping position or tilts his feet. It is especially bothersome to tall people. Even for light electrical blanket, the weight is still beyond the endurance of the toes for supporting the blanket for a long time. Moreover, the electrical blanket has no heating elements at its edge area and thus does not supply additional heat to the foot area where it usually needs more warmth, especially for elderly people.

Although the old style bed had rails or board at foot end, the hard foot end guard is only for restricting the bed clothes from slipping off the bed. It has nothing to do with supporting bed coverings and reducing the weight on the feet, or warming up the feet area. Besides, the hard foot end guard is uncomfortable to the feet.

In order to preserve the elasticity of spring mattresses, it is recommended that such mattresses be periodically turned over. In view of such desirable turning, the fixed positioning of a foot guard on a mattress is impractical.

SUMMARY OF THE INVENTION

Accordingly, the present invention provides a flexible or soft member at foot end of a mattress which extends about foot high above the mattress surface for supporting comforter or blanket at the foot end area. It is detachably and/or pivotably coupled to the mattress for use with either side of the mattress. Provision may be made for selective positioning of the foot guard along the length of the mattress.

Further, the flexible member can be detachably mounted at either of the opposite ends of the mattress with identical mounting means thereon.

Moreover, the flexible member has electrical heating device and thermostat control, similar to the existing electrical blanket heating system, for warming up the feet area.

Furthermore, the flexible member is applicable to water bed.

The flexible member is an elongated cylindrical column, in one of various cross-sectional shapes depending on the mounting means used.

DESCRIPTION OF THE PREFERRED EMBODIMENTS

The following description is of the best presently contemplated mode of carrying out the invention. This description is made for the purpose of illustrating the general principles of the invention and should not be taken in a limiting sense. The scope of the invention is best determined by reference to the appended claims.

The present invention is an improvement of the conventional flat mattresses by providing a flexible or soft foot guard or protector transversely mounted to the mattress at the foot end. The foot protector supports bed clothes at the foot area to reduce the pressure on upward pointed toes of the feet, as shown in FIG. 1.

Figure 1:
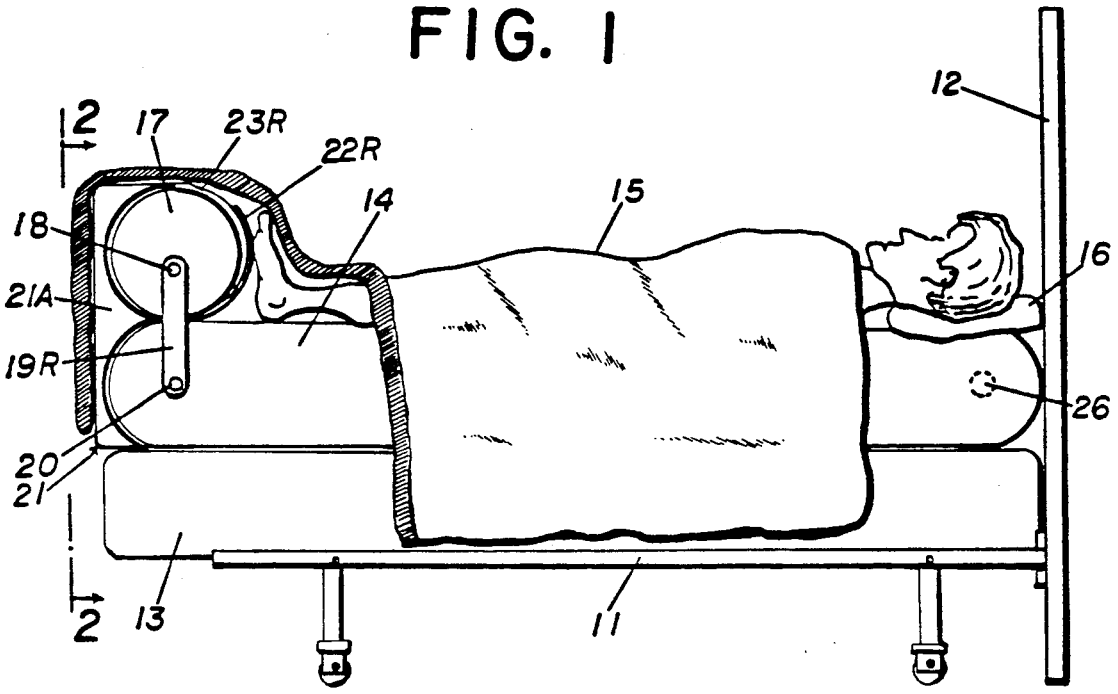
FIG. 1 is a side elevation view of a bed with a person sleeping facing upward on a mattress covered by a comforter which is partially removed to show a foot guard at the mattress foot end in accordance with one embodiment of the present invention.
Figure 2:
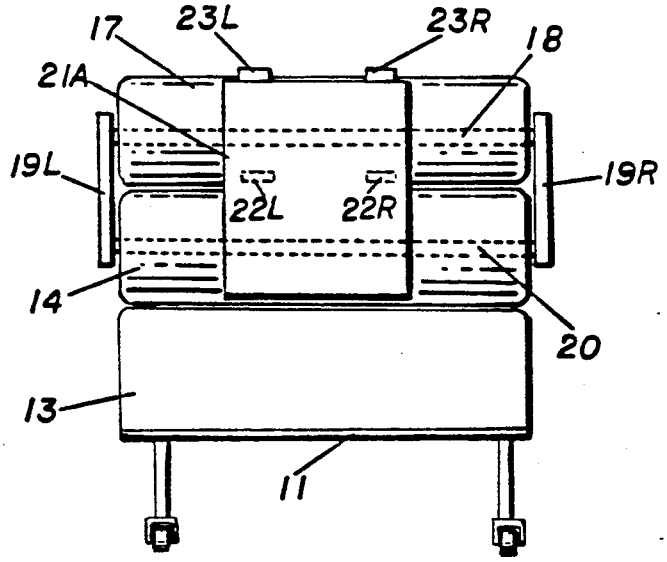
FIG. 2 is an elevation view of the mattress foot end taken in the plane indicated by line 2—2 of FIG. 1 but having the comforter removed.

In FIGS. 1 and 2, a bed frame 11 at the bottom is connected to a vertical head board 12. The frame 11 supports a box spring 13 and a mattress 14 on which a person sleeps. The person sleeps facing upward on the mattress and is covered by a comforter or blanket 15 which is supported by a foot protector 17 nearby the feet. The foot protector 17 is cylindrical and it can be pivotably or detachably coupled to the mattress 14. The pivotable embodiment is first described in reference to FIGS. 1-5 In FIGS. 1 and 2, a center rod 18 is fixedly connected by left and right links 19L and 19R which are in turn pivotably connected to an axle 20 in the center of the mattress 14 foot end. Both the foot protector 17 and the mattress 14 foot end are convex when viewed from the side, as shown in FIG. 1. The links 19L and 19R are identical and are equal to the half thickness of the foot protector 17 and the mattress 14. With the links 19L and 19R as radius and the axle 20 as center line, the foot protector 17 is pivotable for a half circle about the axle 20 to be positioned at either the top or bottom side of the mattress 14 foot end, as similarly shown in dotted lines in FIG. 5 which is for another pivotable mechanism embodiment of FIG. 4. The foot guard is held at each position by a holding unit 21, as shown in FIGS. 1 and 2.

Figure 3:
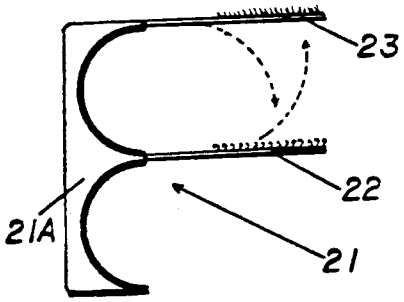
FIG. 3 is a side elevation view of the holding unit for the foot guard in accordance with one embodiment of the present invention.

The side view of the holding unit is illustrated individually in FIG. 3. It comprises a rigid body 21A with one side flat and other side having two concave wells, and two pairs of matched closure strips 22R, 23R and 22L and 23L at the mid and top edges respectively (see also FIG. 2). Depending on the mattress size, e.g. for queen and king sizes, more pairs of closure strips may be required. The concave wells of the rigid body 21 conform to the convex ends of the foot protector 17 and the mattress 14 foot end. The mid closure strips 22R and 22L pass through the gap between the foot protector 17 and the mattress 14 foot end and wrap upward around the foot protector 17 while the top closure strips 23R and 23L wrap downwardly. The matched closure strips meet and hook together that tightly hold the rigid body 21A against the foot protector 17. With the rigid body 21A in place, the foot protector 17 will not move when pushed by the feet of a person because it is blocked by the lower matched concave and convex portions.

Figure 4:
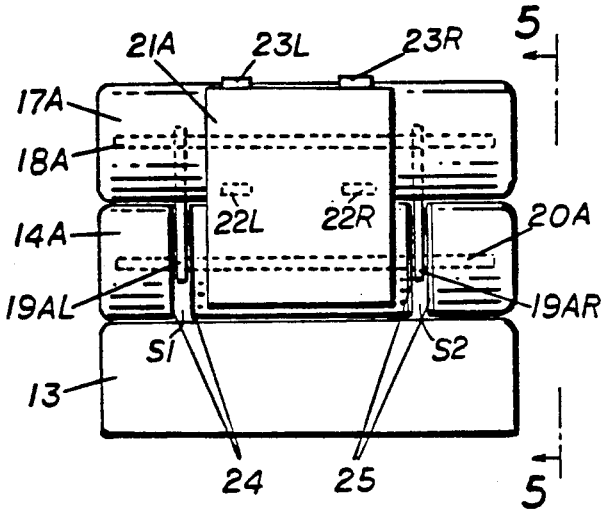
FIG. 4 is an elevation view of a mattress foot end showing another configuration of the pivotable mechanism for the foot guard.
Figure 5:
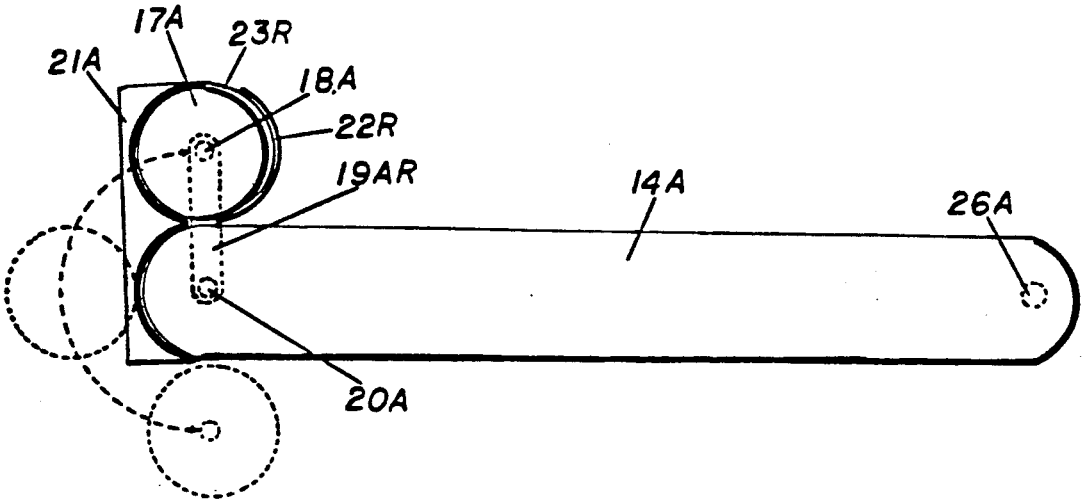
FIG. 5 is a side elevation view taken in the plane indicated by line 5—5 of FIG. 4 showing the holding unit of the foot guard and the mattress, dotted lines showing the pivotable movement and positions of the foot guard when the holding unit is not installed.

FIGS. 4 and 5 show another embodiment of pivotable connection in which two links 19AL and 19AR are pivotable in two slots S1 and S2 at one end of a mattress 14A. Each slot is formed in the mattress end by reinforcement sheets 24 and 25. Left and right links 19AL and 19AR are pivotable in the left and right slots respectively with upper terminals connected to a supporting rod 18A in the foot protector 17A and with lower terminals pivotably connected to an axle 20A in the mattress 14A foot end. These four terminal connections are hidden in the foot protector 17A and the mattress 14A foot end. The foot protector 17A is otherwise the same as the foot protector 17 of FIGS. 1-3. Both ends of the foot protector 17A and the mattress 14A foot end are also convex. The two slots are cut through the convex portion of the mattress 14A foot end down to the axle 20A. Then the foot protector 17A is pivotable with the links 19AL and 19AR as radius and with the axle 20A as center line for a half circle travel, as shown in FIG. 5. The foot protector 17A is also held at its operative position by same holding unit 21.

The two pivotable foot protector described above in reference to FIGS. 1, 2, 4 and 5 can be detachable and mounted at the mattress head end by providing spare axles 26 and 26A at the mattress head end as shown in small dotted circles in FIGS. 1 and 5 respectively.

Figure 6:
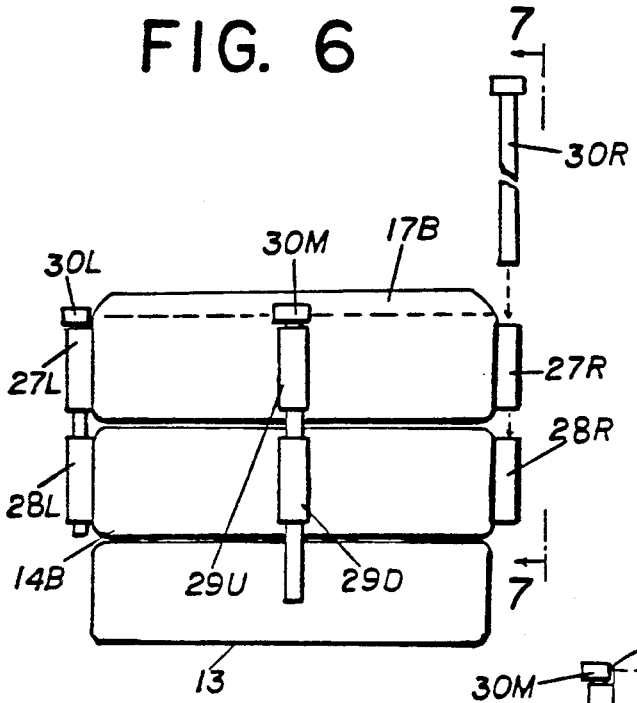
FIG. 6 is a mattress foot end elevation view showing a detachable means of mounting the foot guard on the mattress foot end in accordance with one embodiment of the present invention.
Figure 7:
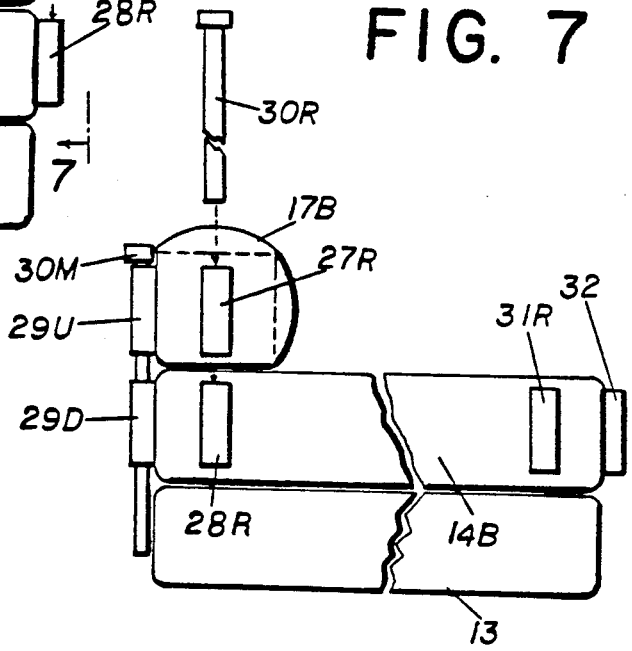
FIG. 7 is a side elevation view taken in the plane indicated by line 7—7 of FIG. 6.

FIGS. 6 and 7 show a detachable means of mounting the foot protector on the mattress foot end. The foot protector 17B and the mattress 14B foot end have flat edges. Holding sleeves 27L, 27R, 28L, 28R, 29U and 29D are provided at left, right and rear edges and are aligned in pairs vertically. Each pair of holding sleeves are connected by inserting a matched size pin, 30L, 30R and 30M. The rear pin 30M is longer than the others which extends downwards beyond the mattress 14B next to the box spring 13. This provides additional resistance against movement of the foot protector 17B outward. For large size mattress more holding sleeves and pins are required at the rear edges. When the pins are inserted in the holding sleeves, the foot protector 17B is held at the up side of the mattress 14B foot end, and will resist being pushed outward. The foot protector 17B can be easily detached and reinstalled either at the opposite side, or at the head end where spare holding sleeves 31L (hidden from view in FIG. 7), 31R and 32 are provided.

Figure 8:
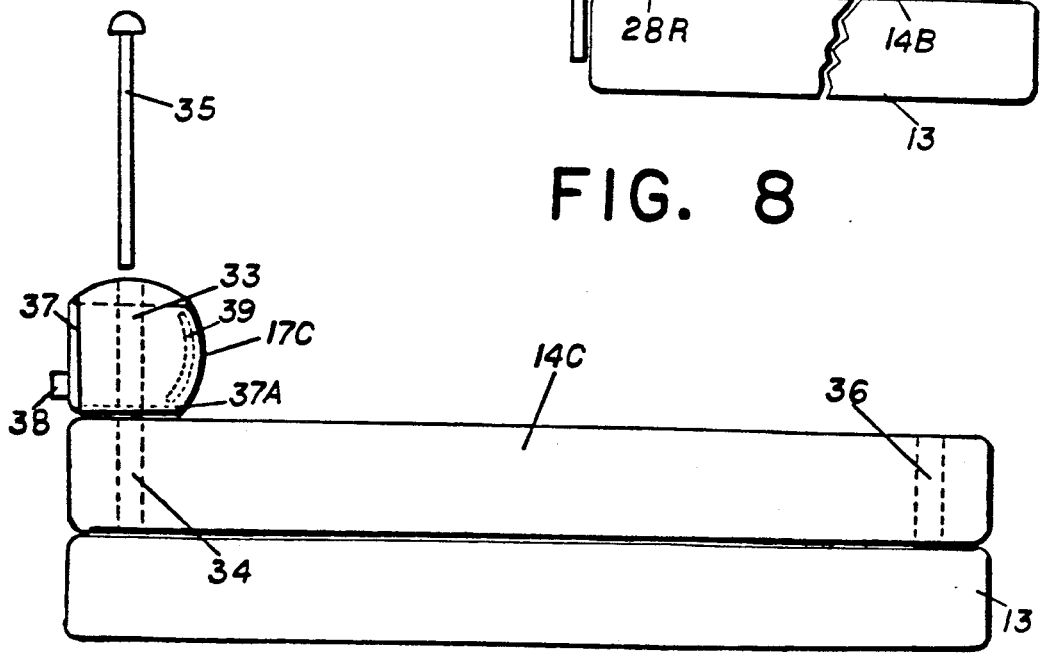
FIG. 8 is a side elevation view showing another detachable means of installing the foot guard on the mattress foot end.

Further, instead of using holding sleeves, holding holes can be provided in the related members. FIG. 8 shows vertically aligned holes 33 and 34, indicated by dotted lines, at the inside of foot protector 17C and mattress 14C foot end respectively. Matched size pin 35 is inserted in the aligned holes. Additional holes and pins hidden from view in FIG. 8 are provided along the length of the foot protector 17C and width of the mattress 14C. The foot protector 17C can be held on the top side of the mattress 14C foot end, or on lower side, or on the head end where hole 36 is indicated in dotted lines. The holes are located through the spring coils inside of the mattress 14C and the foot protector 17C for firm support of the pin 35.

The cylindrical foot protector or foot guard can be in different cross-sectional shapes, for instance, circular, rectangular, half-circular-half-rectangular, triangular or trapezoidal. It can be made of various materials, for instance, mattress like spring, sofa-like cushion and spring, pneumatic set. Those materials which are soft need a rigid frame for support; for instance, a half circular rigid shell may be set at the foot protector outward convex side, not shown. A rigid plate 37 is set at the foot protector 17C outward side, as shown in FIG. 8, as an example. The rigid plate 37 can also be modified to a right-angle unit at the foot protector outward and bottom sides, as shown in FIG. 8 in which plate 37A (shown in dotted lines) extends from plate 37.

The above described closure strips are self-gripping fastener strip or tape also known as Velcro fastener. The strips come in different sizes, from narrow to wide, so the number of the strips 22R, 22L, 23R, and 23L also depend on the strip size. A wide self-gripping fastener tape may be stronger than three or four narrow tapes. Further, the self-gripping fastener strip can be replaced by other fasteners, such as button, snaps, ties, zippers, etc.

The mattress can be water bed type, and the flexible foot protector can be installed in the water bed foot end either in fixed, or in detachable configurations as described above.

The flexible foot protector can be equipped with electric heating elements 39 under surface coverings which can be controlled by a thermal control on the outside. The electric heating system is well known, detail description and drawing are therefore omitted. In FIG. 8 a thermostat control 38 is shown on the rigid plate 37.

Further embodiments of the generic concept of the present invention are illustrated with reference to FIGS. 9 to 23.

Figure 10:
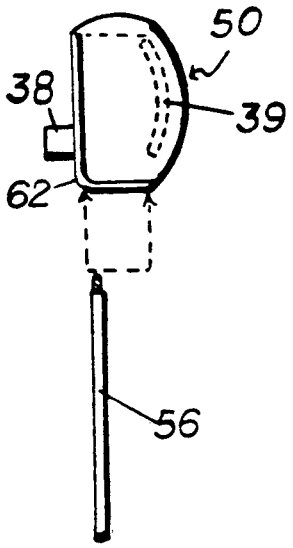
FIG. 10 is a detail view showing the alternate attachment of holding pins to the foot guard.
Figure 11:
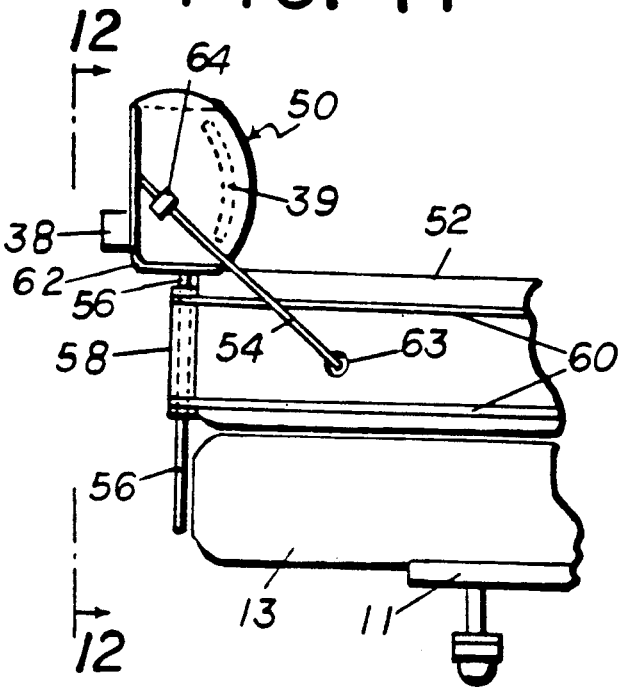
FIG. 11 is a partial view showing the configuration of the foot guard overhanging at the end of the mattress.
Figure 12:
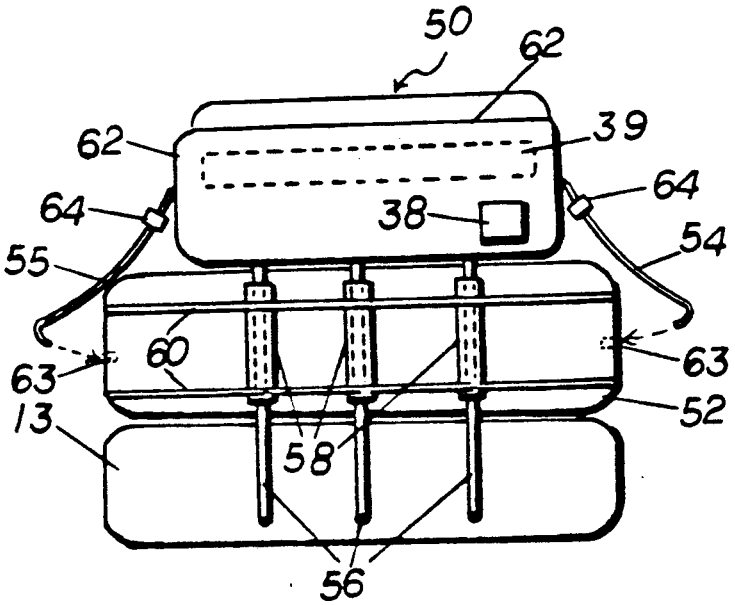
FIG. 12 is an end view taken along line 12—12 in FIG. 11.

In the embodiment shown in FIGS. 9–12, the foot protector 50 is attached to the mattress 52 by a combination of straps 54 and holding pins 56 and sleeves 58. More particularly, sleeves 58 are positioned at one end of the mattress 52 by reinforcement belts 60 tied around the sides of the mattress. The number of sleeves 58 will depend on the width of the mattress 52, however at least two sleeves would be required to stabilize attachment of the foot protector 50. FIG. 12 shows a configuration of three pins and sleeves for the foot protector 50 which incidently does not cover the entire width of the mattress.

The foot protector 50 shown has a generally semicircular cross sectional profile. A rigid angled bracket 62 is attached to the rear and bottom sides of the foot protector 50. Matching number of pins 56 as the sleeves 58 are screwed into the base of the bracket 62, either near the corner of the base or at the leading edge of the base (FIG. 10). When the foot protector 50 is attached to the mattress 52 by inserting the pins 56 into the sleeves 58, the foot protector 50 would assume either position shown in FIGS. 9 or 11 depending on the location of attachment of the pins 56 to the base of the bracket 62. In FIG. 11, the foot protector 50 over-hangs from the edge of the mattress such that the effective laying surface of the mattress is maximized.

To resist outward bending motion under pressure from user's feet, the pins 56 are made longer than the thickness of the mattress 52 such that the pins lean against the box. spring 13. In addition and optionally, one or more braces such as straps 54 may be provided between the bracket 62 and an anchor point on the side of the mattress 52 to further secure the foot protector 50. Specifically, the strap 54 is anchored by providing a hook which latches on a hole 63 provided on the side of the mattress 52 (see similar parts in FIG. 17 and the discussion related thereto below). The strap 54 has a buckle 64 which allows the adjustment of the effective length of the strap 54 to keep it taut between the hole 63 and the bracket 62. A similar strap 55 may be provided on the other side of the mattress(FIG. 12). A similar arrangement of sleeves 58A and holes 63A may be provided at the other end of the mattress to allow for repositioning of the foot protector when the mattress is turned over. Alternatively, the strap 60 may be made removable, in which case allowing for repositioning of the sleeves without having to provide for an additional set of sleeves.

Like the previous embodiments, an electrical heating element 39 may be provided within the foot protector which is functionally controlled by a thermostat control 38.

Figure 13:
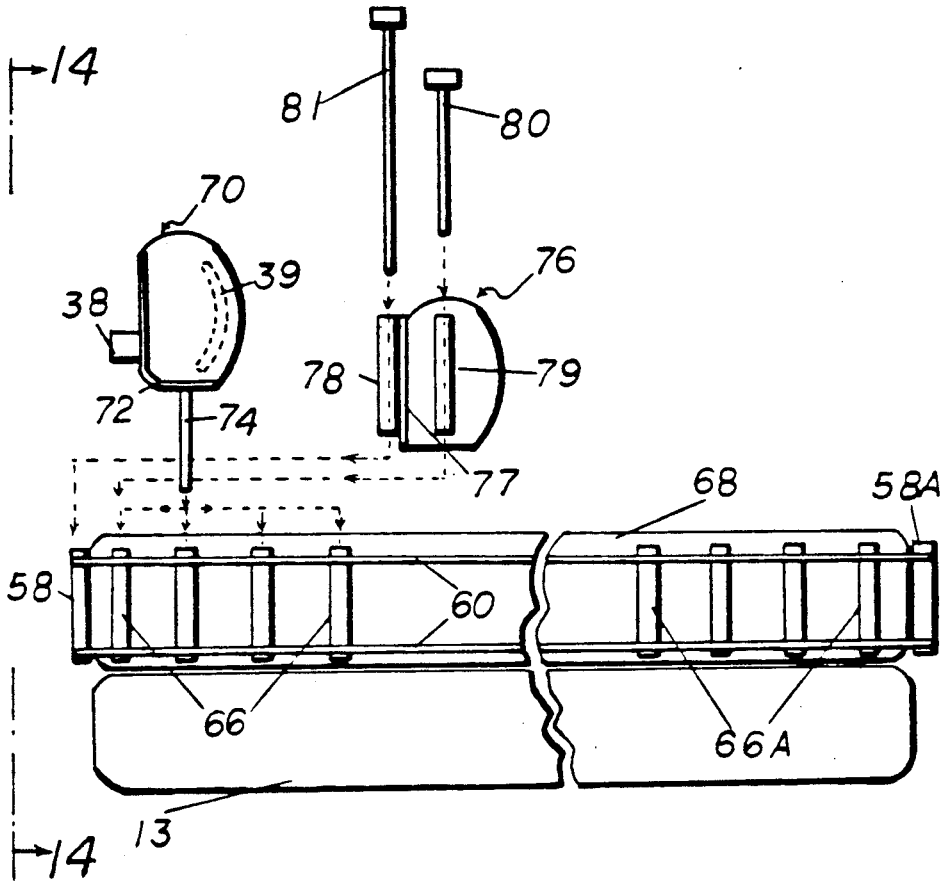
FIG. 13 is a side elevation view of yet another embodiment of foot guard attachment to the mattress.
Figure 14:
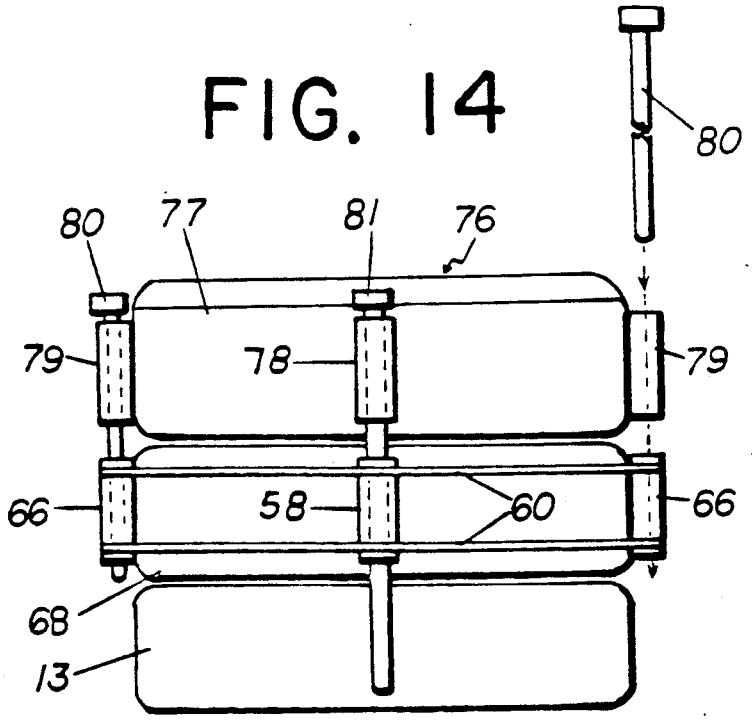
FIG. 14 is an end view taken along line 14—14 in FIG. 13.

FIGS. 13 and 14 show a variation of the preceding embodiment. Here, additional holding sleeves 66 are strapped on the sides of the mattress 68. Two alternate configurations of foot protectors may be used. In a first configuration, the foot protector 70 is as long as the width of the mattress 68 and has a bracket 72 similar to that in the preceding embodiment. Holding pins 74 are however attached to the base of the bracket 72 near its longitudinal ends for insertion into the sleeves 66 on the sides of the mattress 68. The foot protector 70 can be positioned at will at one of many locations along the sides of the mattress as defined by the sleeves 66, so as to accommodate users of different heights.

In a second configuration, the foot protector 76 has holding sleeves 78 and 79 attached along its back plate bracket 77 and at its two ends. Holding pins 80 and 81 are inserted through the sleeves 78 and 79 on the foot protector 76 and the sleeves 58 and 66 on the mattress 68 when attaching the foot protector to the mattress. The foot protector 76 can be positioned at the end of the mattress 68 (FIG. 14) or at various locations along the length of the mattress. The pin 81 is however not used for the latter locations. A similar set of sleeves 66A may be provided at the other end of the mattress to increase flexibility of use.

Figure 15:
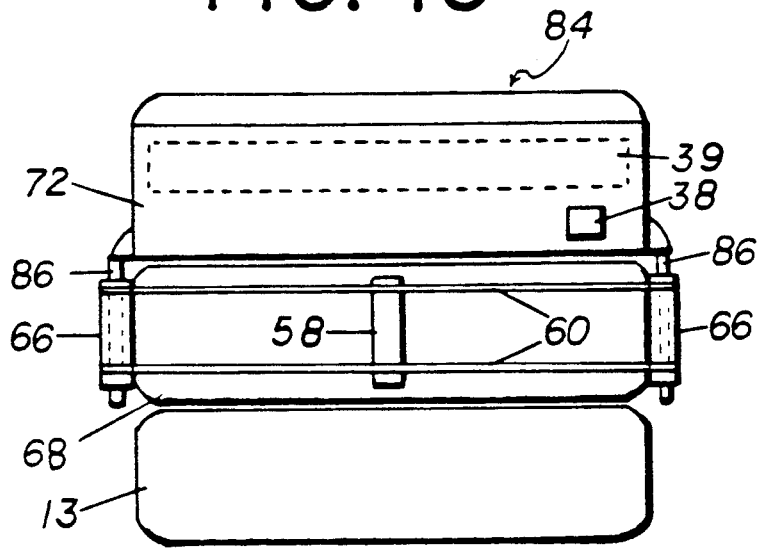
FIG. 15 is an end view of an embodiment modified from FIG. 14.

FIG. 15 shows a variation of the foot protector in FIG. 14. Instead of providing sleeves on the foot protector 84, fixedly attached pins 86 are provided at the two ends of the foot protector 84. Heating element 39 and thermostat control 38 may be provided.

Figure 9:
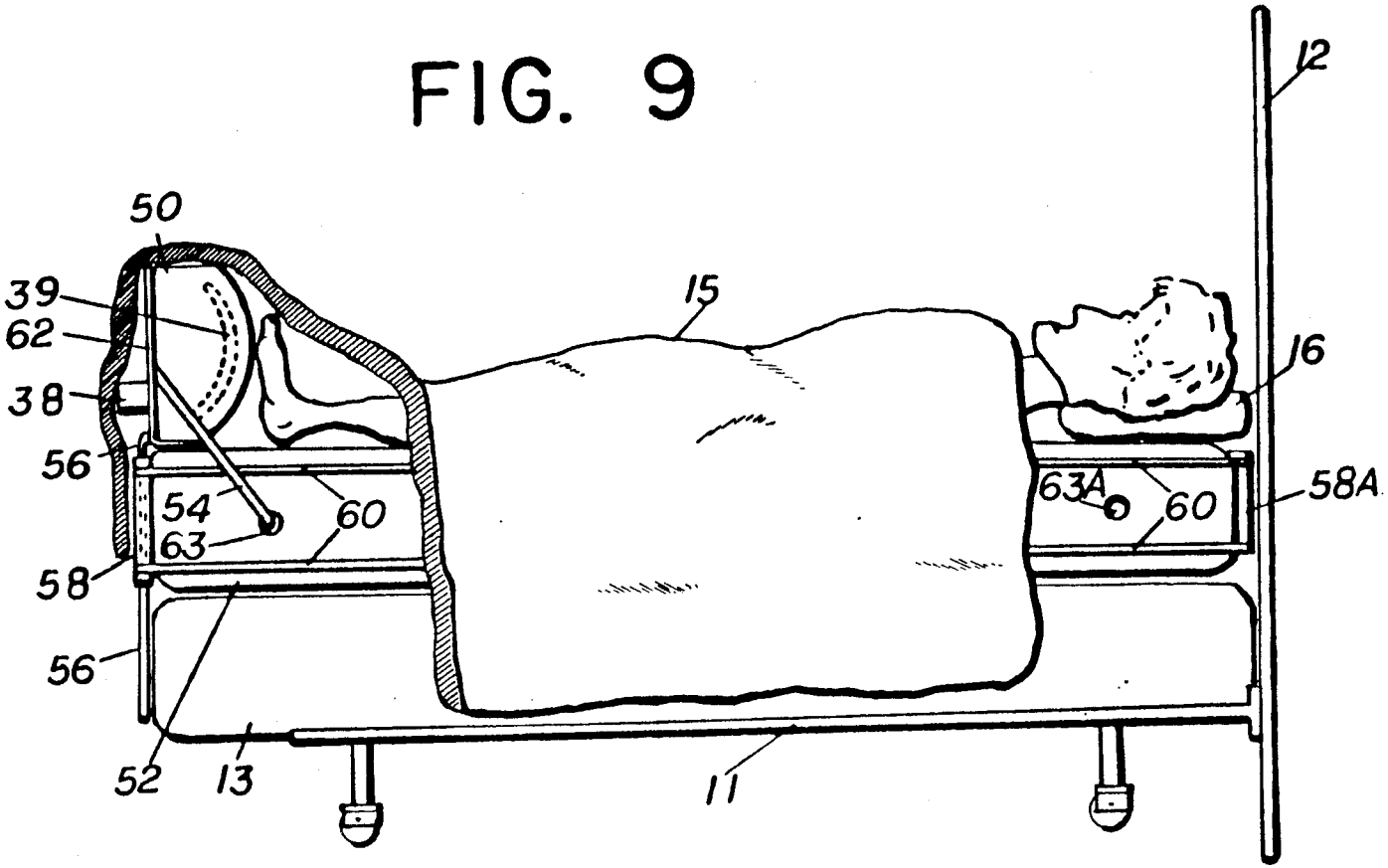
FIG. 9 is a side elevation view showing a further embodiment of detachable attachment of the foot guard to the mattress.
Figure 16:
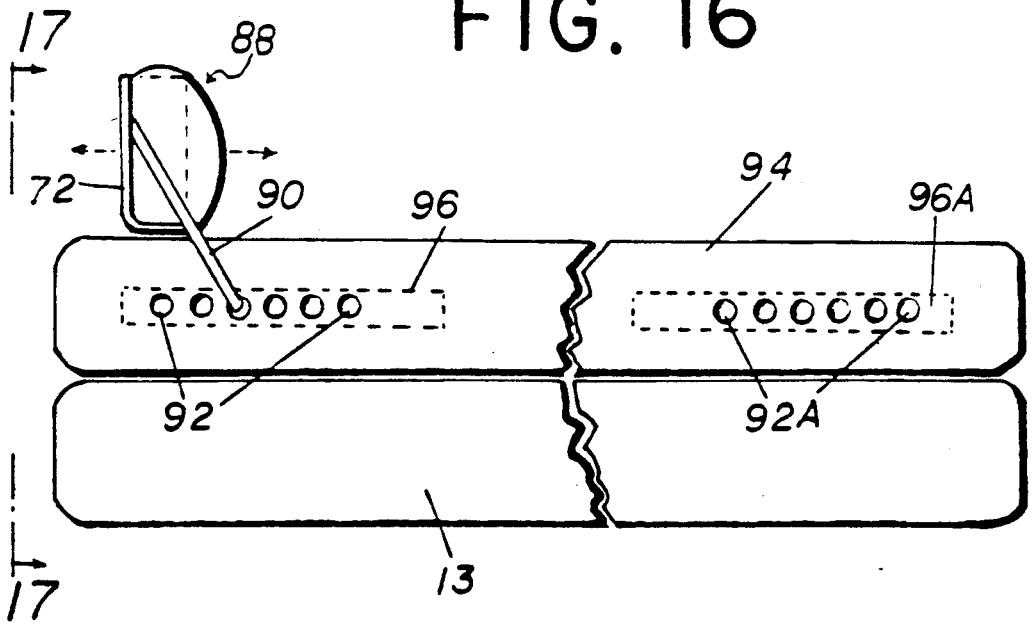
FIG. 16 is a side elevation view of still another embodiment of foot guard attachment.
Figure 17:
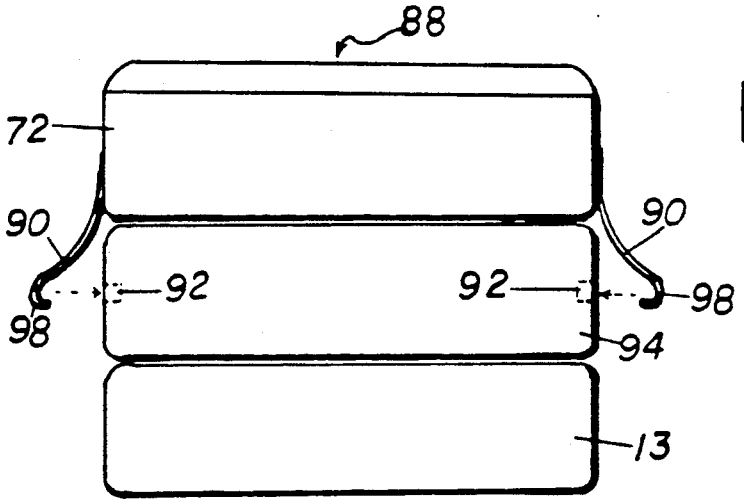
FIG. 17 is an end view taken along line 17—17 in FIG. 16.

FIGS. 16 and 17 show a variation of the embodiment shown in FIG. 9. Holding pins are omitted in this embodiment. The foot protector 88 is attached to the mattress using braces or straps 90 only. The straps 90 each has a hook 98 at its end. A series of holes 92 are provided along the sides of the mattress 94 to define various anchoring locations for the hooks 98. It is noted that the angle of the strap 90 with respect to the horizon may be selected based on the understanding that the smaller the angle, the higher the force the foot protector can withstand against pushing from a user's feet. The holes 92 may be defined on strips 96 of rigid metal or hard plastic which are sewn in the sides of the mattress 94 so as to prevent tearing of the fabric from the pull of the hooks 98. The straps 90 may be rigid instead of flexible. Similar strips 96A having holes 92A may be provided at the other end of the mattress.

Figure 18:
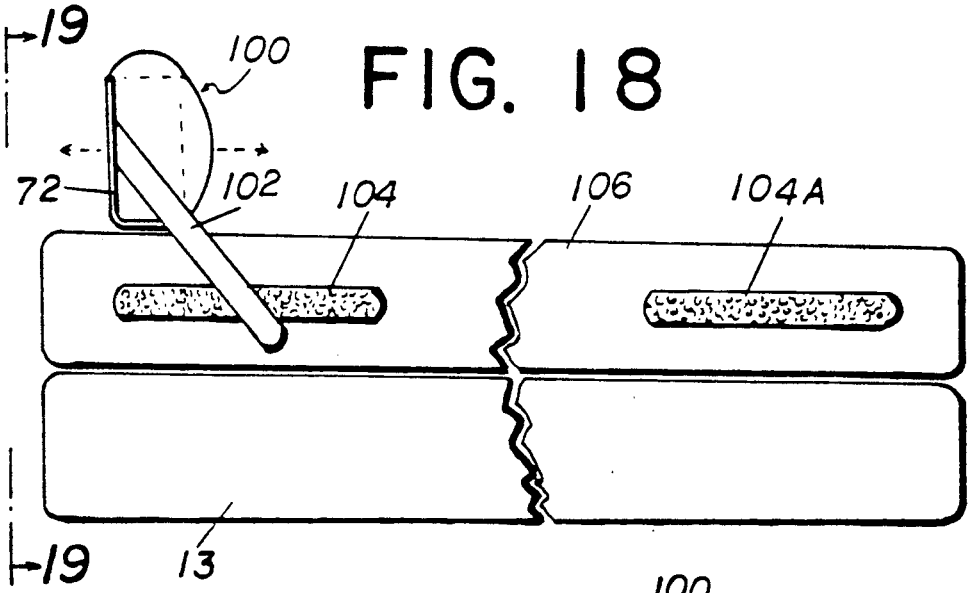
FIG. 18 is a side elevation view of a further embodiment of foot guard attachment.
Figure 19:
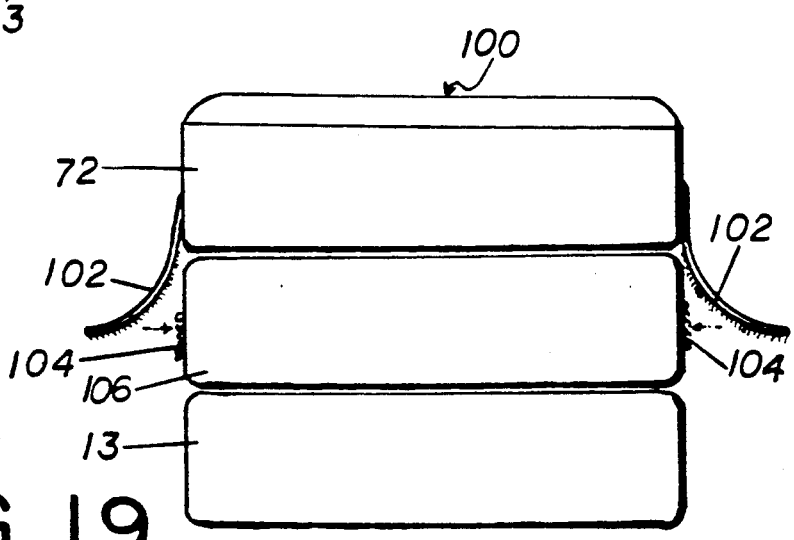
FIG. 19 is an end view taken along line 19—19 in FIG. 18.

FIGS. 18 and 19 show a variation wherein attachment of the foot protector 100 is by using self-gripping straps 102. More particularly, the straps 102 have either surfaces comprising of loops or hooks which can grip on strips 104 having surfaces comprising of complementary hooks or loops, respectively, to from a secure attachment to the mattress 106. One example of the self-gripping fastener material, similar to the closure strips 22 and 23 in FIG. 3, is commercially available under the trademark Velcro. Strips 104A may be provided at the other end of the mattress.

Figure 20:
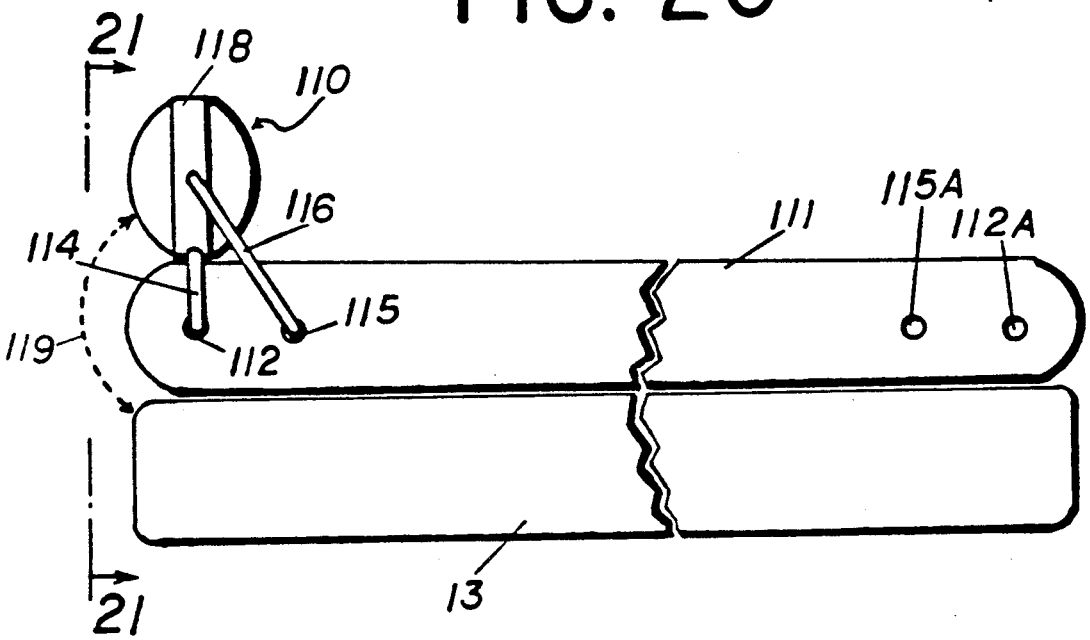
FIG. 20 is an side elevation view showing another pivotal attachment of foot guard to the mattress.
Figure 21:
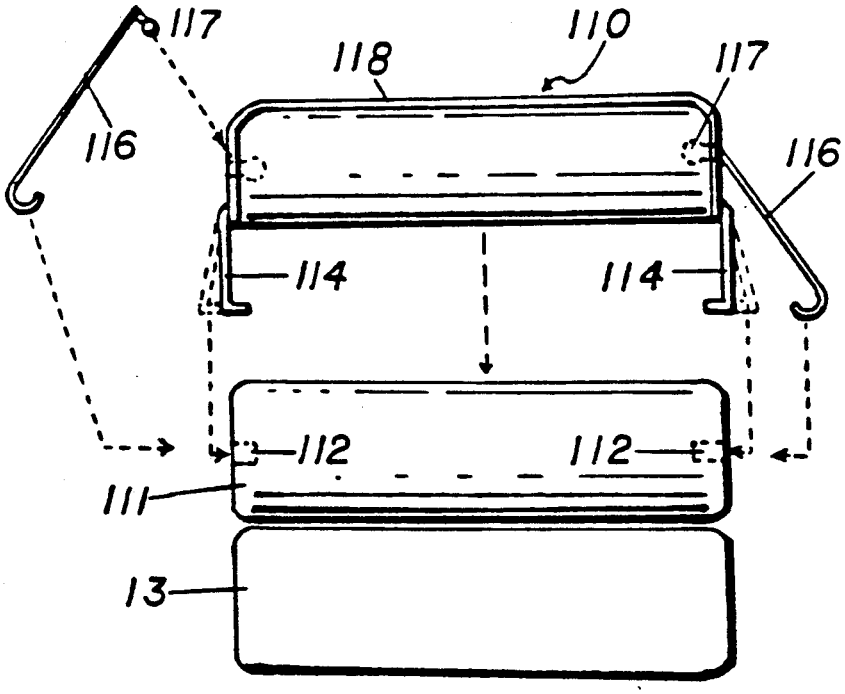
FIG. 21 is an end view taken along line 21—21 in FIG. 20.

FIGS. 20 and 21 show an embodiment which uses a combination of pivotal attachment and reinforcement straps to attach the guard to the mattress. Much like the embodiment shown in FIG. 1, the foot protector 110 is pivotably attached to the mattress 111 at hinge holes 112. The specific example shown in FIGS. 20 and 21 has a pivot 114 which is detachably attached to the mattress 111 by latching the pivots 114 to the hinge holes 112. Straps 116 are fixedly or detachably attached to the foot protector bracket 118 for anchoring to holes 115 along the sides of the mattress. Referring to FIG. 21, the straps 116 are shown to each have a ball joint 117 at the end inserted into the foot protector bracket 118. The foot protector 110 may be rotated along the dotted line 119 when the mattress is turned over or when it is desired to move the foot protector out of the way to obtain a flat mattress surface. In the example shown in FIG. 20, hook type straps are used. In the alternate, self-gripping fastening straps may be used. Further, other means of fastening may be used such as buttons, snaps etc. for anchoring the straps to the sides of the mattress. Strap holes 115A and hinge holes 112A may be provided at the other end of the mattress.

Figure 22:
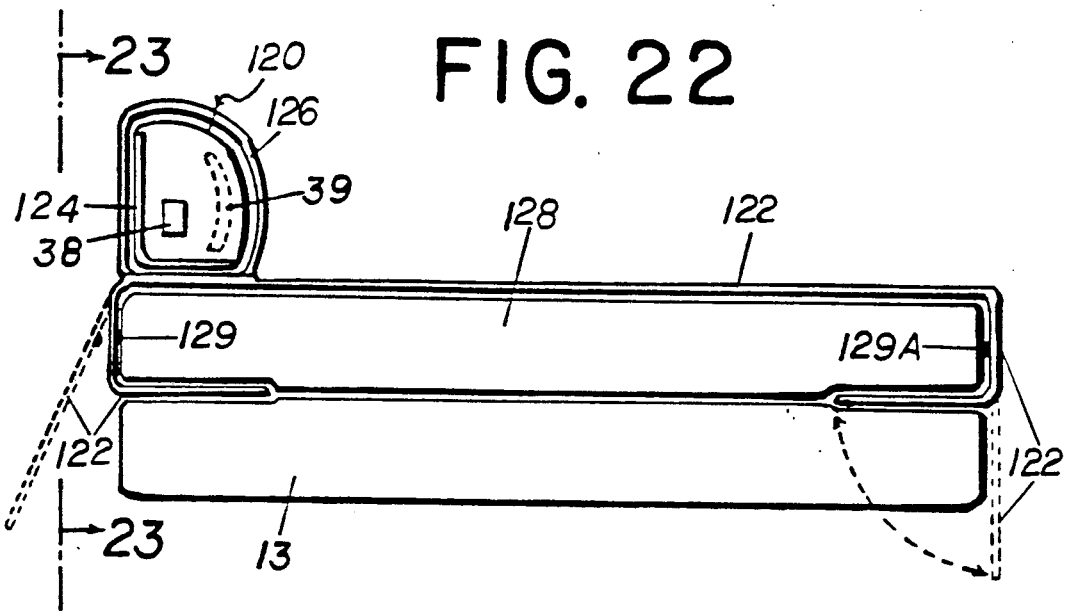
FIG. 22 is a side elevation view showing a foot guard as part of a bed sheet or bed pad.
Figure 23:
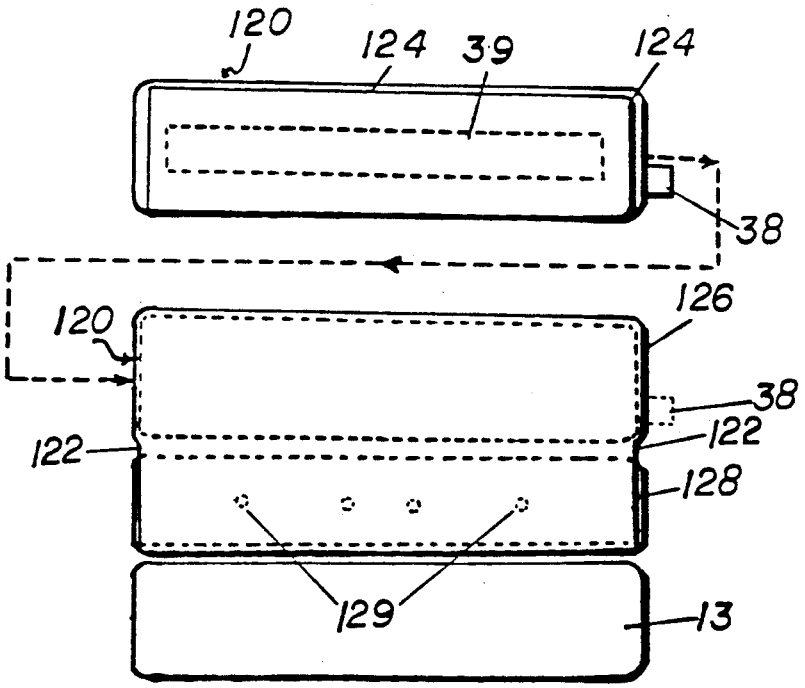
FIG. 23 is an end view taken along line 23—23 in FIG. 22.

FIGS. 22 and 23 show another embodiment of the present invention in which the foot protector 120 is made part of a bed sheet or mattress protective pad 122. The foot protector 120 has a rigid angled bracket 124 for stabilizing the foot protector 120, and a rounded surface facing the user's foot. The foot protector 120 in this case is removably inserted into a duct 126 defined by the fabric of the bed sheet or protective pad. The foot protector may be removed when laundering of the bed sheet or pad 122 is desired. The foot protector 120 is attached to the mattress 128 by folding both the foot and head ends of the bed sheet or bed pad 122 and tucking the ends underneath the foot and head ends of the mattress. Under the weight of a user on the bed sheet or bed pad 122 and the mattress 128, the foot protector 120 is prevented from moving from this tucked position. The exact location of the foot protector 120 on the mattress 128 may be selected as desired to accommodate users of different height. The foot protector 120 can be selectively repositioned on the mattress 128 at a desired location by tucking more or less of the bed sheet or bed pad 122 at the head and foot ends of the mattress. To further secure the foot protector 120, the bed sheet or bed pad 122 may be attached to the mattress by any appropriate fasteners such as matched buttons or snaps 129 and 129A. For ease of illustration, the bed sheet or bed pad 122 in FIGS. 22 and 23 is shown to be as wide as the mattress 128. Typically for bed sheets and some bed pads, they are wider than the mattress. It would be necessary to fold and tuck the sides of the bed sheet or bed pad underneath the sides of the mattress. Similar fasteners as fasteners 129 and 129A may be provided to securely attach the bed sheet or bed pad to the mattress 128.

Like some of the previous embodiments, heating elements 39 and thermostat control 38 may be provided in the foot protector 120. While some of the previous embodiments (FIGS. 16–21) do not show heating elements and thermostat control, it is understood that similar devices may be implemented in the foot protectors described.

In most cases, the length of mattresses having the foot protector is larger than standard size mattresses since four or five inches need to be allowed for the flexible foot protector.

It is understood that the above described embodiments are only for illustration of the present invention, many other embodiments can be derived without departing from the scope and spirit of the invention.

I claim:

1. A mattress having a foot guard mounted thereon to reduce the weight of blankets and the like bedclothes o the toes of a person who is lying face up on the mattress, comprising:

a generally flat mattress having a top surface and a bottom surface;

a generally cylindrical guard member; and connection means attached to the mattress for pivotably coupling the guard member to a section of the mattress and positioning the guard member transversely across the top surface at said section of the mattress, said guard member extending above the top surface to about the length of a person's foot, whereby the guard member supports the weight of the bedclothes from pressing on the toes of the person.

2. A mattress as in claim 1 wherein the connection means comprises pivoting means for pivoting the guard member from a position on the top surface of the mattress to a similar position on the bottom surface of the mattress, whereby the guard member can be positioned alternately on the top and bottom surfaces when the mattress is periodically turned over.

3. A mattress as in claim 2 wherein the pivoting means comprises at least one link connecting the guard member to a pivot location at one end of the mattress.

4. A mattress as in claim 3 wherein the pivoting means detachably couples the guard member to said one end of the mattress.

5. A mattress as in claim 4 wherein the pivoting means detachably couples the guard member to another end of the mattress after the guard member has been detached from said one end of the mattress.

6. A mattress as in claim 5 further comprising means for preventing the guard member from pivoting after it has been pivoted to a desired position on either the top or bottom surface of the mattress.

7. A mattress as in claim 6 wherein the means for preventing comprises one or more braces anchoring the guard member to the mattress.

8. A mattress having a foot guard mounted thereon to reduce the weight of blankets and the like bedclothes on the toes of a person who is lying face up on the mattress, comprising:

a generally flat mattress having a top surface and a bottom surface;

a generally cylindrical guard member; and connection means comprising at lest one generally longitudinal member of which one end is attached to the guard member and another end is attached to the mattress for coupling the guard member to a section of the mattress and positioning the guard member transversely across the top surface of the mattress, said guard member extending above the top surface to about the length of a person's foot, whereby the guard member supports the weight of the bedclothes from pressing on the toes of the person.

9. A mattress as in claim 8 wherein the connections means includes means for detachably coupling the guard member to said section of the mattress, 10. A mattress as in claim 8 wherein the connection means includes means for detachably coupling the guard member to any one of several sections of the mattress.

11. A mattress as in claim 8 further comprising means for heating the guard member.

12. A mattress as in claim 8 wherein the connection means comprises:

a first set of holding sleeves provided along edges of the mattress at said section; and holding pins connecting the guard member and the first set of holding sleeves.

13. A mattress as in claim 12 wherein the first set of holding sleeves are symmetrically positioned with respect to the top and bottom surfaces of the mattress such that the guard member can be similarly positioned on the bottom surface of the mattress, whereby the guard member can be positioned alternately on the top and bottom surfaces when the mattress is periodically turned over.

14. A mattress as in claim 12 wherein the connection means further comprises a second set of holding sleeves provided on the sides of the guard member, wherein the first and second sets of holding sleeves are vertically aligned when the guard member is positioned on the top surface of said section of the mattress for connection by the holding pins.

15. A mattress as in claim 12 wherein the first set of holding sleeves are positioned along each longitudinal side of the mattress such that the guard member may be positioned at any one of several sections of the mattress by connecting the guard member to selected holding sleeves at a selected longitudinal location.

16. A mattress as in claim 12 wherein the connection means further comprises brace means in addition to the holding pins for anchoring the guard member.

17. A mattress having a foot guard mounted thereon to reduce the weight of blankets and the like bedclothes on the toes of a person who is lying face up on the mattress, comprising:

a generally flat mattress having a top surface and a bottom surface;

a generally cylindrical guard member; and connection means for attaching the guard member to the mattress, said connection means having positioning means for selective positioning the guard member transversely across any one of a plurality of longitudinal locations on the top surface of the mattress, said guard member extending above the top surface to about the length of a person's foot, whereby the guard member supports the weight of the bedclothes from pressing on the toes of the person.

18. A mattress as in claim 17 wherein the positioning means comprises means for bracing the guard member to each longitudinal side of the mattress.

19. A mattress as in claim 18 wherein anchoring holes are provided on each side of the mattress and the means for bracing comprises hook means for latching onto the holes.

20. A mattress as in claim 19 wherein there are a row of holes provided along each side of the mattress such that the guard member may be anchored to holes at a selected longitudinal location of the mattress.

21. A mattress as in claim 18 wherein the means for bracing includes a strap having a surface finished with hook or loop material and a strip of material on each side of the mattress having a surface finished with a complementary loop or hook material, respectively, such that the strap can be securely fastened to the strip.

22. A mattress as in claim 17 wherein the positioning means comprises first set of holding sleeves which are positioned along each longitudinal side of the mattress such that the guard member may be positioned transversely across any one of several longitudinal locations of the mattress by connecting the guard member to selected holding sleeves at a selected longitudinal location.

* * * * *